US009457350B2

(12) United States Patent
Dickinson et al.

(10) Patent No.: US 9,457,350 B2
(45) Date of Patent: Oct. 4, 2016

(54) RACK FOR USE WITH A TEMPERATURE CONTROLLED BATH, AND A RELATED METHOD

(71) Applicant: Thermo Fisher Scientific (Asheville) LLC, Asheville, NC (US)

(72) Inventors: Randall D. Dickinson, Kennebunk, ME (US); Mark J. Estrella, Scarborough, ME (US); Nathan N. Lang, Rochester, NH (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 70 days.

(21) Appl. No.: 14/163,242

(22) Filed: Jan. 24, 2014

(65) Prior Publication Data

US 2015/0209788 A1 Jul. 30, 2015

(51) Int. Cl.
*B01L 9/06* (2006.01)
*B01L 7/02* (2006.01)

(52) U.S. Cl.
CPC .. *B01L 7/02* (2013.01); *B01L 9/06* (2013.01); *B01L 2300/0609* (2013.01); *B01L 2300/0809* (2013.01); *B01L 2300/185* (2013.01)

(58) Field of Classification Search
CPC ..... B01L 9/06
See application file for complete search history.

(56) References Cited

U.S. PATENT DOCUMENTS

| | | | |
|---|---|---|---|
| 3,300,055 | A | 1/1967 | Rohr |
| 5,114,680 | A | 5/1992 | Obermiller et al. |
| 5,133,939 | A | 7/1992 | Mahe |
| 5,632,388 | A | 5/1997 | Morrison et al. |

FOREIGN PATENT DOCUMENTS

| | | | |
|---|---|---|---|
| DE | 25 28 152 | A1 | 1/1977 |
| FR | 2127141 | A5 | 10/1972 |

OTHER PUBLICATIONS

Espacenet, English Machine Translation of FR2127141A5, published Oct. 13, 1972, retrieved from http://worldwide.espacenet.com on Jul. 1, 2015 (3 pages).
Espacenet, English Machine Translation of DE2528152A1, published Jan. 20, 1977, retrieved from http://worldwide.espacenet.com on Jul. 1, 2015 (6 pages).
European Patent Office, European Search Report, Application No. EP15152146.5, dated Jun. 15, 2015 (8 pages).

*Primary Examiner* — Paul Hyun
(74) *Attorney, Agent, or Firm* — Wood, Herron & Evans, LLP

(57) ABSTRACT

A rack is provided for use with a temperature controlled bath having a housing containing a reservoir with a supply of working fluid and an opening providing access to the reservoir. The rack includes a rack body, and a vessel support supported by the rack body and configured for supporting at least one vessel. The rack further includes a supporting foot assembly supported by the rack body and including a plurality of support feet. Each support foot is configured for movement between a stowed position and a deployed position.

11 Claims, 11 Drawing Sheets

RACK FOR USE WITH A TEMPERATURE CONTROLLED BATH, AND A RELATED METHOD

TECHNICAL FIELD

The present invention relates generally to temperature controlled baths and, more particularly, to racks for supporting vessels in temperature controlled baths.

BACKGROUND

Temperature controlled baths, such as recirculating baths, are used in laboratory settings for providing a controlled temperature working liquid, such as water, in a reservoir. A user may utilize the temperature controlled bath by placing their material samples in the reservoir or by recirculating the working liquid between the reservoir and an external application. Conventional temperature controlled bath applications include placing material samples into vials, test tubes, beakers or other vessels, and then placing the vessels in the reservoir. The temperature of the working liquid which surrounds the vessels is controlled by the temperature controlled bath to control the temperature of the material samples. For example, the temperature controlled bath may move the working liquid past heating or cooling elements so as to achieve a desired temperature of the working liquid, and thereby control the temperature of the material samples.

Racks are sometimes used to hold the vessels that are placed into a temperature controlled bath. For example, a user may position the vessels in a rack, and then place the rack into the temperature controlled bath such that the vessels are in contact with the working fluid. When the user desires to access the material samples contained in the vessels, the user removes the rack from the temperature controlled bath. Because part of the rack and the vessels had been in contact with the working fluid, a user typically placed the rack into a container, onto a tray, or onto an absorbent material in order to prevent the working fluid from dripping off the rack and/or vessels and contaminating the laboratory setting with working fluid. In addition, the working fluid that is taken out of the reservoir when a rack is removed from the temperature controlled bath diminishes the amount of working fluid in the reservoir. Thus, working fluid must periodically be added to the reservoir in order to replace the working fluid that is taken out.

Thus, there is a need for improvements relating to temperature controlled baths and racks used therewith.

SUMMARY OF THE INVENTION

The present invention overcomes the foregoing problems and other shortcomings, drawbacks, and challenges of racks for temperature controlled baths. While the invention will be described in connection with certain embodiments, it will be understood that the invention is not limited to these embodiments. To the contrary, this invention includes all alternatives, modifications, and equivalents as may be included within the spirit and scope of the present invention.

In one embodiment of the present invention, a rack is provided for use with a temperature controlled bath having a housing containing a reservoir with a supply of working fluid and an opening providing access to the reservoir. The rack includes a rack body, and a vessel support supported by the rack body and configured for supporting at least one vessel. The rack further includes a supporting foot assembly supported by the rack body and including a plurality of support feet. Each support foot is configured for movement between a stowed position and a deployed position.

In another embodiment of the present invention, a temperature controlled bath is provided in combination with a rack. The temperature controlled bath includes a housing containing a reservoir with a supply of working fluid and an opening providing access to the reservoir. The rack includes a rack body, and a vessel support supported by the rack body and configured for supporting at least one vessel. The rack further includes a supporting foot assembly supported by the rack body and including a plurality of support feet. Each support foot is configured for movement between a stowed position and a deployed position.

In another embodiment of the present invention, a method is provided for using a rack with a temperature controlled bath having a housing containing a reservoir with a supply of working fluid and an opening providing access to the reservoir. The rack supports at least one vessel and includes a supporting foot assembly having a plurality of support feet moveable between a stowed position and a deployed position. The method includes moving the support feet to the stowed position, and lowering the rack into the working fluid in the reservoir.

BRIEF DESCRIPTION OF THE DRAWINGS

The accompanying drawings, which are incorporated in and constitute a part of this specification, illustrate embodiments of the invention and, together with a general description of the invention given above, and the detailed description of the invention given below, serve to explain the principles of the invention.

DETAILED DESCRIPTION

Figure 1A:
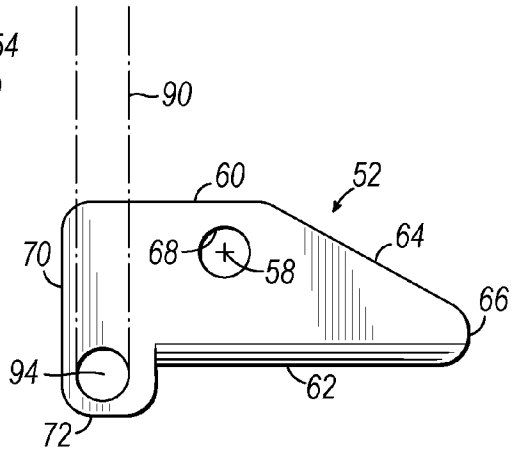
FIG. 1A is a side elevational view showing an individual support foot as used in the supporting foot assembly of the rack of FIG. 1.

Referring now to the figures, a rack 10 is shown for use with a temperature controlled bath 12 in one exemplary embodiment. The rack 10 will first be described with reference to FIGS. 1, 1A, and 2-4, and then the use of the rack 10 with the temperature controlled bath 12 will be described with reference to FIGS. 5, 6A-6E, and 7.

The rack 10 generally includes a rack body 14, which includes a base 16 and two opposed side walls 18*a*, 18*b*. The side walls 18*a*, 18*b* are secured to, and extend generally upwardly from, the base 16. The rack 10 also includes a vessel support 20 for supporting one or more vessels 22, such as test tubes, as will be described more fully below. In the particular embodiment shown, the vessel support 20 includes a base tray 24 and an upper tray 26. The rack 10 also includes handles 28*a*, 28*b* associated with the side walls 18*a*, 18*b*, respectively.

The vessel support 20 is adjustably supported by the side walls 18*a*, 18*b*. In particular, each of the side walls 18*a*, 18*b* includes positioning adjustment slots 30 for adjusting the position of the base tray 24 and the upper tray 26. Each adjustment slot 30 includes a central channel 32 and a plurality of sockets 34 extending from and connected with the central channel 32, such as on both sides of the central channel 32. Retaining members 36 engage the base tray 24 and upper tray 26 to secure them along the adjustment slots 30. In particular, retaining members 36 extend through the respective side walls 18*a*, 18*b* in the adjustment slots 30 and engage receiving bores 38 formed in the base tray 24 and the upper tray 26. The retaining members 36 may rest in the sockets 34 of the adjustment slot 30, for example. As shown, the base tray 24 is supported by the side walls 18*a*, 18*b* generally near the base 16, and the upper tray 26 is supported by the side walls 18*a*, 18*b* above and spaced from the base tray 24.

The base tray 24 includes a plurality of apertures 40, each being configured for receiving part of a vessel 22, as will be explained further below. In a similar manner, the upper tray 26 includes a plurality of apertures 42, each being configured for receiving a part of a vessel 22 different from the part received in an aperture 40, as will also be explained further below. The upper tray 26 has a generally rectangular shape when viewed from the top, except for cutouts 44 formed at corners of the upper tray 26. Similarly, the base tray 24 has a generally rectangular shape when viewed from the top, except for cutouts 45 formed at corners of the base tray 24.

The rack 10 also includes a supporting foot assembly 50 supported by the rack body 14. The supporting foot assembly 50 is configured for supporting the rack 10 with respect to the temperature controlled bath 12, as will be described further below. In the embodiment shown, the supporting foot assembly 50 includes a plurality of support feet 52. In particular, the rack 10 includes four support feet 52, with each support foot 52 being positioned generally near a lower corner 54 of the rack 10. As shown, two of the support feet 52 are associated with the side wall 18*a*, and two of the support feet 52 are associated with the side wall 18*b*.

Figure 1:
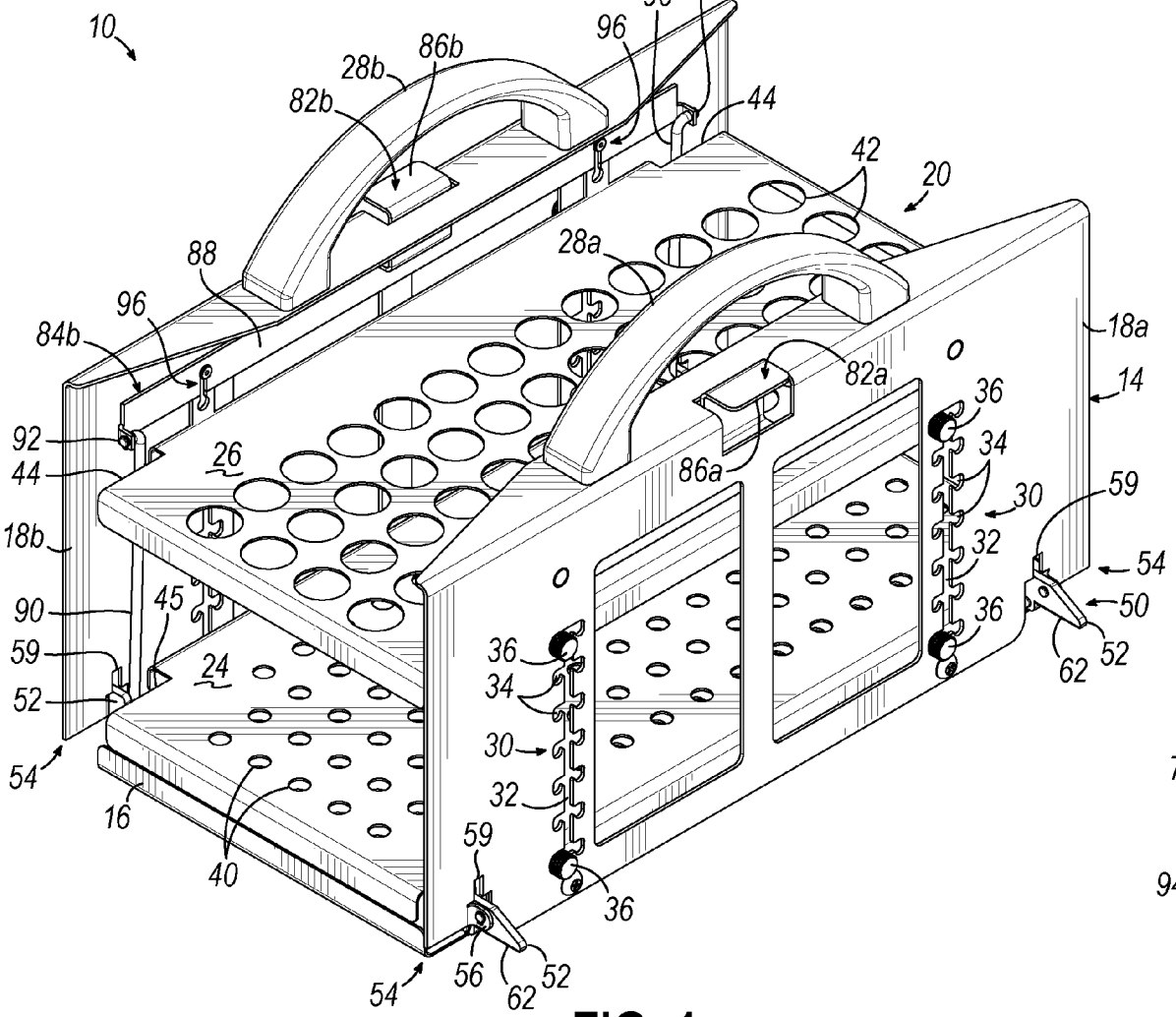
FIG. 1 is an isometric view showing a rack that includes a supporting foot assembly for supporting the rack with respect to a temperature controlled bath. The supporting foot assembly includes a plurality of support feet, which are shown in FIG. 1 in a deployed position.
Figure 2:
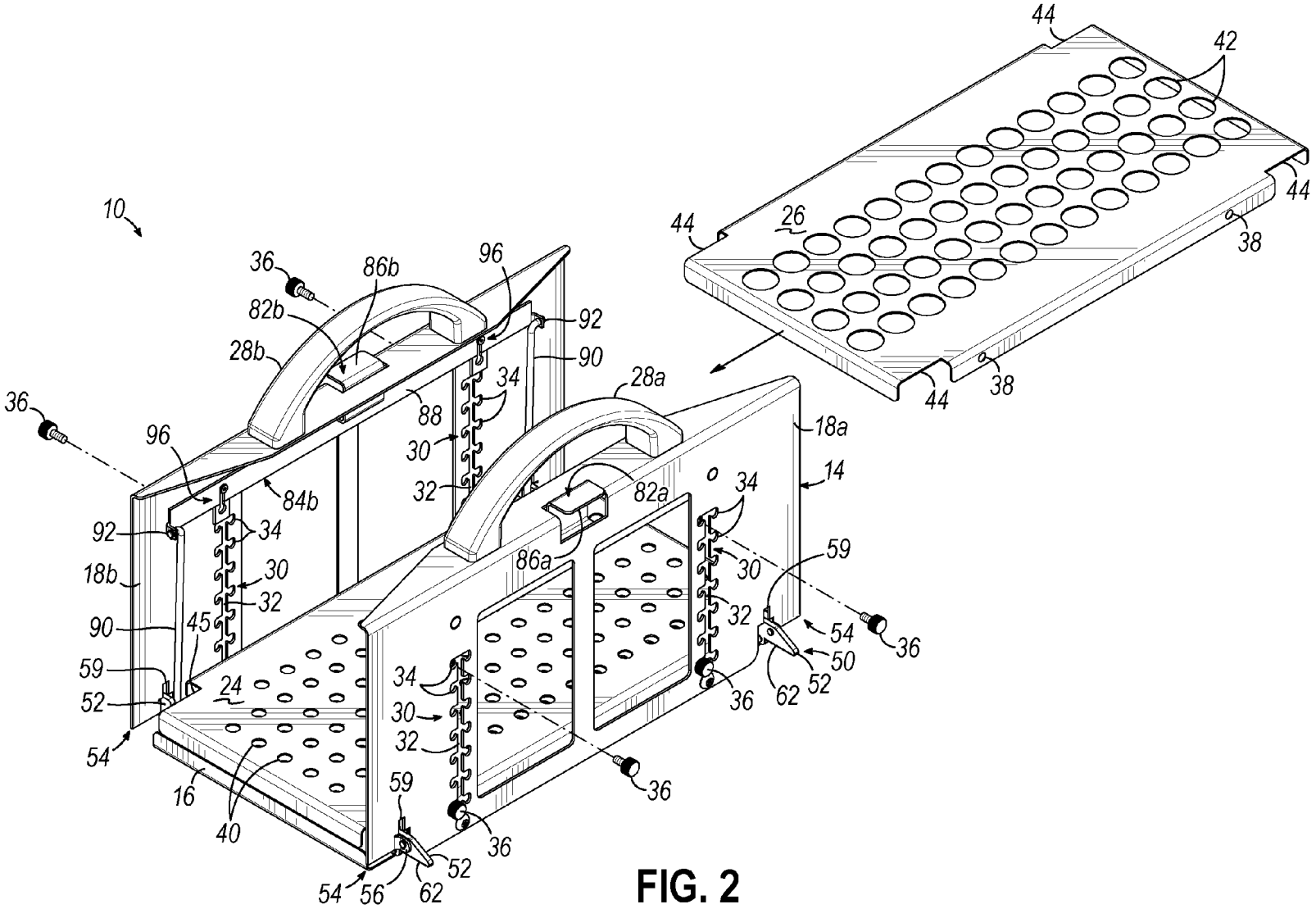
FIG. 2 is a partially disassembled view of the rack of FIG. 1, showing an upper tray of a vessel support separated from side walls of the rack.

The support feet 52 are moveable between a stowed position (FIG. 3) and a deployed position (FIG. 1). In the exemplary embodiment shown and described, the support feet 52 are pivotably moveable between the stowed position and the deployed position. Tabs 56 extend outwardly from the side walls 18*a*, 18*b*, and each support foot 52 is pivotably connected to a tab 56 for pivoting movement on a pivot axis 58. Openings 59 are formed in each side wall 18*a*, 18*b* near the tabs 56, and the support feet 52 partially extend through the openings 59 such that a portion of each support foot 52 resides generally inside a respective side wall 18*a*, 18*b*, and another portion of each support foot 52 resides generally outside the respective side wall 18*a*, 18*b*. When in the deployed position, a support foot 52 extends outwardly the respective side wall 18*a*, 18*b* (FIG. 1).

In an alternative embodiment, the support feet 52 may be configured to move between their respective stowed positions and deployed positions in a manner other than pivoting, such as linear or orbital movement, for example.

Figure 3:
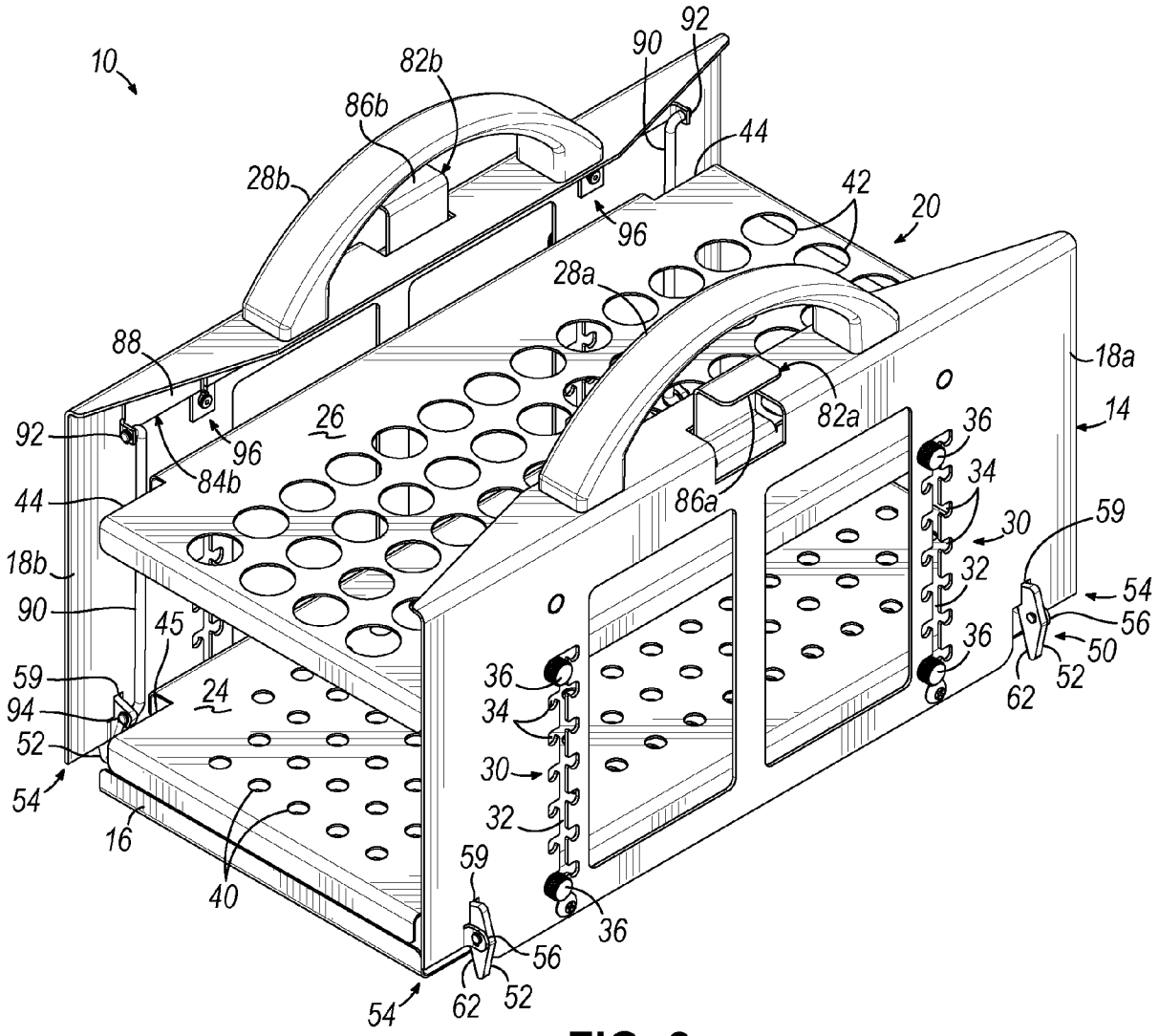
FIG. 3 is an isometric view of the rack of FIG. 1, with the support feet being in a stowed position.

As shown in FIG. 1A, each support foot 52 includes an upper surface 60 and an opposed base surface 62. In the embodiment shown, the upper surface 60 and the base surface 62 are generally parallel. When a support foot 52 is in the deployed position, the base surface 62 is in a generally horizontal orientation (FIG. 1). When a support foot 52 is in the stowed position, the base surface 62 is in an inclined, non-horizontal, orientation (FIG. 3).

The upper surface 60 extends for a shorter length than the base surface 62, and a sloped surface 64 extends downwardly from the upper surface 60 toward the base surface 62. The sloped surface 64 and the base surface 62 meet at a tip 66, which may be rounded, as shown. The pivot axis 58 of each support foot 52 extends through a pivot point 68 that is positioned beneath the upper surface 60 and proximate the intersection of the upper surface 60 and the sloped surface 64.

Generally opposite the tip 66, the upper surface 60 and the base surface 62 are connected by a back surface 70. Each support foot 52 includes a heel 72 proximate the back surface 70, and in particular, proximate the intersection of the back surface 70 and the base surface 62. In the embodiment shown, the heel 72 extends slightly below the base surface 62.

An adjustment mechanism 80 is provided for moving or adjusting one or more of the support feet 52. In particular, the adjustment mechanism 80 may be used to move the support feet 52 to their respective stowed positions, and/or to move the support feet 52 to their respective deployed positions. For example, the adjustment mechanism 80 may be used to move a support foot 52 between (1) its stowed position and (2) its deployed position, or between (1) its deployed position and (2) its stowed position. Also, the adjustment mechanism 80 may be used to move a support foot 52 between (1) any position intermediate its stowed position and its deployed position and (2) the stowed position or, between (1) any position intermediate its stowed position and its deployed position and (2) the deployed position.

Figure 4:
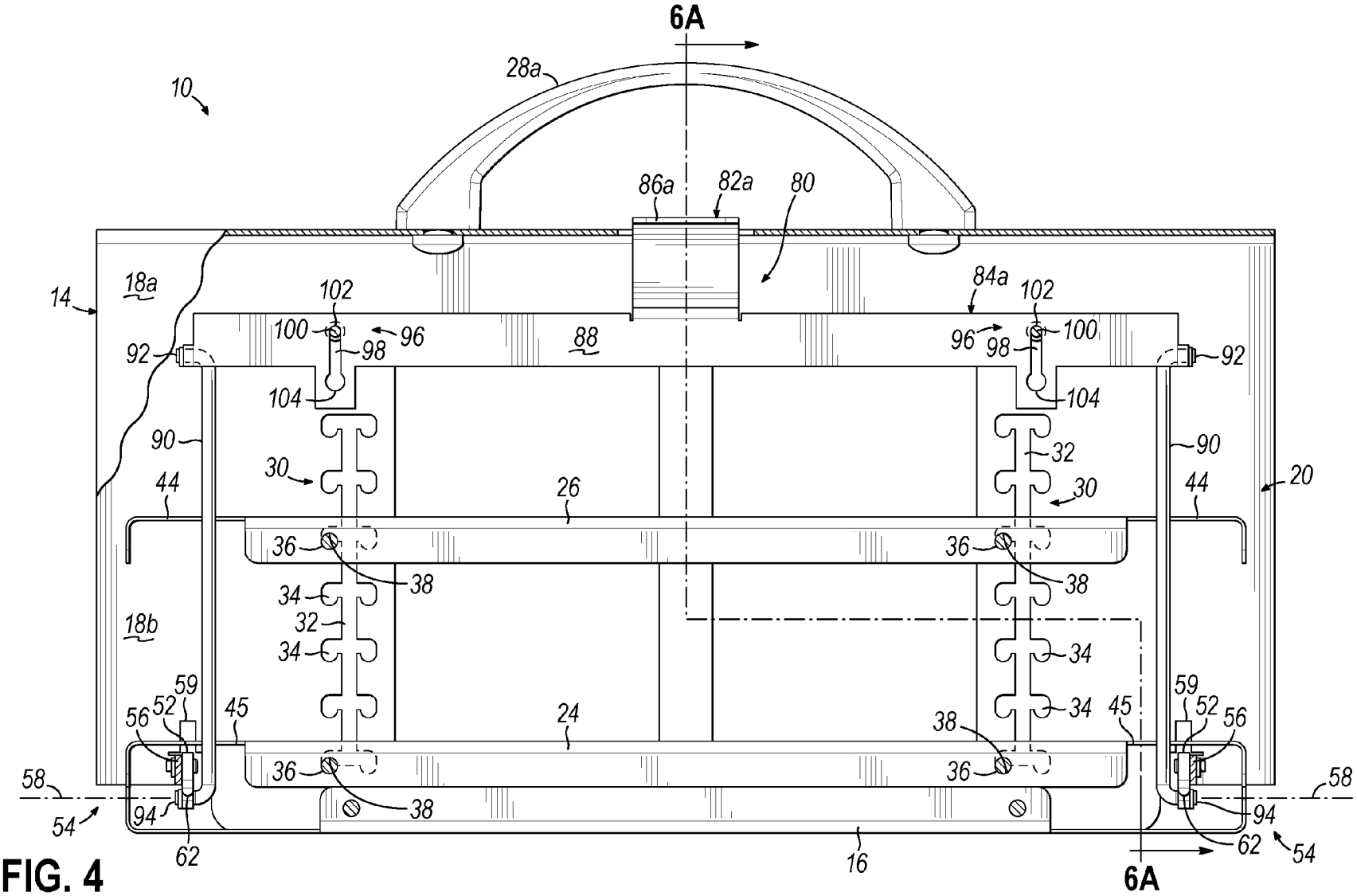
FIG. 4 is a schematic elevational view in partial cross section of the rack of FIG. 1.
Figure 5:
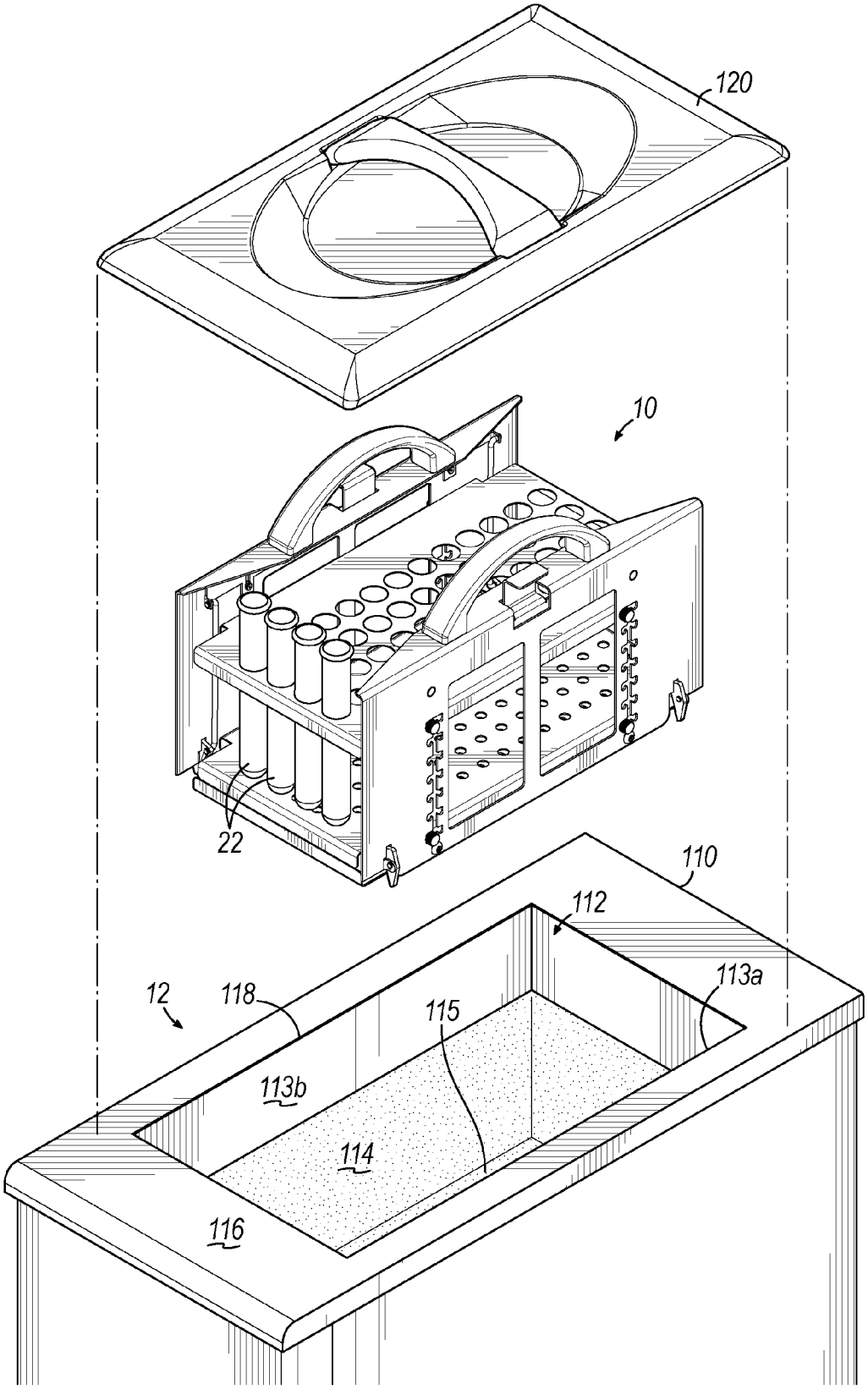
FIG. 5 is an isometric view showing the rack of FIG. 1 carrying several vessels and being situated in the environment of a temperature controlled bath, with the support feet being in a stowed position.

In the embodiment shown, the adjustment mechanism 80 includes aspects associated with one side of the rack body 14, and similar aspects associated with another side of the rack body. In particular, the adjustment mechanism 80 includes finger-actuated levers 82*a*, 82*b* and linkages 84*a*, 84*b*. The linkages 84*a*, 84*b* operatively connect the respective levers 82*a*, 82*b* with at least one of the support feet 52 associated with the respective side walls 18*a*, 18*b*. In particular, the lever 82*a* is operatively connected with the two support feet 52 associated with the side wall 18*a* via the linkage 84*a*. The lever 82*a* and linkage 84*a* are shown in FIG. 4, for example. Similarly, the lever 82*b* is operatively connected with the two support feet 52 associated with the side wall 18*b* via the linkage 84*b*. The views provided in FIGS. 6A-6E show the lever 82*a* and linkage 84*a* are associated with one side of the rack body 14, and the lever 82*b* and linkage 84*b* are associated with another side of the rack body 14.

As shown, the levers 82*a*, 82*b* are positioned proximate the handles 28*a*, 28*b*, and include generally horizontally-extending finger tabs 86*a*, 86*b*. The levers 82*a*, 82*b* may be moved in the up-down direction, such as by engaging the finger tabs 86*a*, 86*b*. The linkages 84*a*, 84*b* are positioned generally inside the side walls 18*a*, 18*b*.

Each linkage 84*a*, 84*b* includes a crossbar 88 connected with and positioned beneath an associated respective lever 82*a*, 82*b*. Each crossbar 88 is connected with the associated support feet 52 via connector rods 90. In particular, each crossbar 88 is connected with a connector rod 90 at a connection 92. Each connector rod 90 extends downwardly from the crossbar 88 through the cutouts 44 of the upper tray 26 and the cutouts 45 of the base tray 24 and is connected with a support foot 52 at a connection 94. In particular, a connector rod 90 is connected at the connection 94 with the heel 72 of a support foot 52. The connections 92 between the connector rods 90 and the crossbars 88 may be a pivotable connection, for example. Similarly, the connections 94 between the connector rods 90 and the support feet 52 may also be a pivotable connection, for example.

Up-down movement of the levers 82*a*, 82*b* thereby causes corresponding up-down movement in the linkages 84*a*, 84*b*. Up-down movement of the linkages 84*a*, 84*b*, in turn, causes pivotal movement of the support feet 52 about the respective pivot axes 58. In particular, upward movement of the levers 82*a*, 82*b* cause the support feet 52 to pivot toward their respective stowed positions. Downward movement of the levers 82*a*, 82*b* cause the support feet 52 to pivot toward their respective deployed positions.

The movement of the levers 82*a*, 82*b* and/or the linkages 84*a*, 84*b* may be constrained such that the support feet 52 cannot be moved beyond the stowed and deployed positions. To that end, a limit assembly 96 can be provided for limiting the extent of up-down movement of the linkages 84*a*, 84*b*. In particular, each of the linkages 84*a*, 84*b* includes two such limit assemblies 96. Each limit assembly 96 includes a guide channel 98 extending through the crossbar 88, and a post 100 extending from a respective side wall 18*a*, 18*b* and received in the guide channel 98. Each guide channel 98 extends between an upper end 102 and a lower end 104. The crossbar 88 may be moved downwardly until the posts 100 reach the upper ends 102 of the guide channels 98 and stop further downward movement of the crossbar 88. In the other direction, the crossbar 88 may be moved upwardly until the posts 100 reach the lower ends 104 of the guide channels 98 and stop further upward movement of the crossbar 88. In addition to limiting the extent of movement of the crossbar 88, the guide channel 98 also limits the direction of movement of the crossbar 88 to the up-down direction.

In some embodiments of the present invention, the support feet 52 may be configured to automatically move to their respective deployed positions. For example, the weight of the adjustment mechanism 80, including the levers 82*a*, 82*b* and the linkages 84*a*, 84*b* may tend to cause the support feet 52 to pivot toward their respective deployed positions. The support feet 52 may be moved to their respective stowed positions by moving the levers 82*a*, 82*b* and linkages 84*a*, 84*b* upwardly. The support feet 52 will remain in the stowed position so long as the levers 82*a*, 82*b* and linkages 84*a*, 84*b* are held upwardly. Once the levers 82*a*, 82*b* are released, the weight of the levers 82*a*, 82*b* and linkages 84*a*, 84*b* may cause them to move downwardly, thereby causing the support feet 52 to automatically move to their respective deployed positions.

In other embodiments of the present invention, the support feet 52 may not automatically move to any position. Rather, the support feet 52 may be selectively moved to their respective stowed and deployed positions using the adjustment mechanism 80, including the levers 82*a*, 82*b* and the linkages 84*a*, 84*b*. In addition, the support feet 52 may be selectively moved to their respective stowed and deployed positions by manipulating the support feet 52 themselves, such as by pushing or pulling on any of the upper surface 60, the base surface 62, the sloped surface 64, the tip 66, the back surface 70, and the heel 72.

Referring next to FIGS. 5, 6A-6E, and 7, use of the rack 10 with the temperature controlled bath 12 is now described. The temperature controlled bath 12 includes a housing 110 that holds a reservoir 112 with a supply of working fluid 114. The reservoir 112 generally includes reservoir side walls 113*a*, 113*b*, and a reservoir base 115. The reservoir side walls 113*a*, 113*b* extend upwardly from the reservoir base 115. The temperature controlled bath 12 may include one or more temperature control units, such as a heating unit and/or a cooling unit, for adjusting the temperature of the working fluid 114 in the reservoir 112.

The housing 110 includes an upper surface 116. An opening 118 in the upper surface 116 provides access to the reservoir 112 and the working fluid 114 therein. The temperature controlled bath 12 may also include a lid 120 that mates with the housing 110 to cover the opening 118.

As discussed above, the rack 10 includes the vessel support 20 for supporting one or more vessels 22. In the embodiment shown, the vessels 22 are in the form of test tubes, but it will be appreciated that other forms of vessels can also be used with the rack 10, such as vials, beakers, and other containers. Each vessel 22 generally includes a vessel body 122 that extends between a base end 124 and an upper end 126. For the vessels 22 shown, the base end 124 is rounded and closed, and the upper end 126 is open. The vessel bodies 122 provide an internal space 128 for containing a material sample.

Figure 6A:
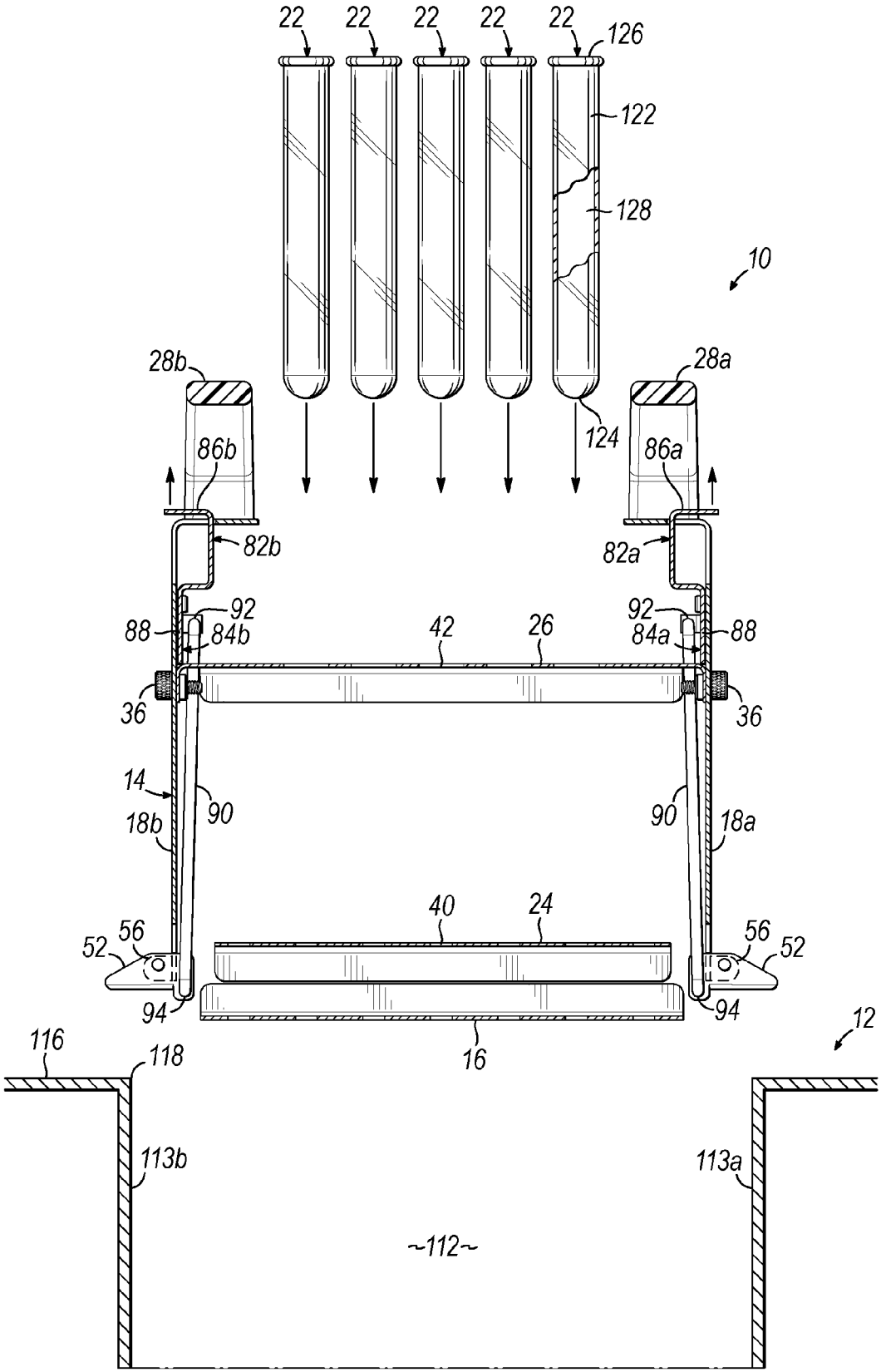
FIG. 6A is a schematic elevational view showing the vessels being lowered into the vessel support of the rack of FIG. 5, with the rack being positioned above an opening in a housing of the temperature controlled bath, and with the support feet being in a deployed position.
Figure 6B:
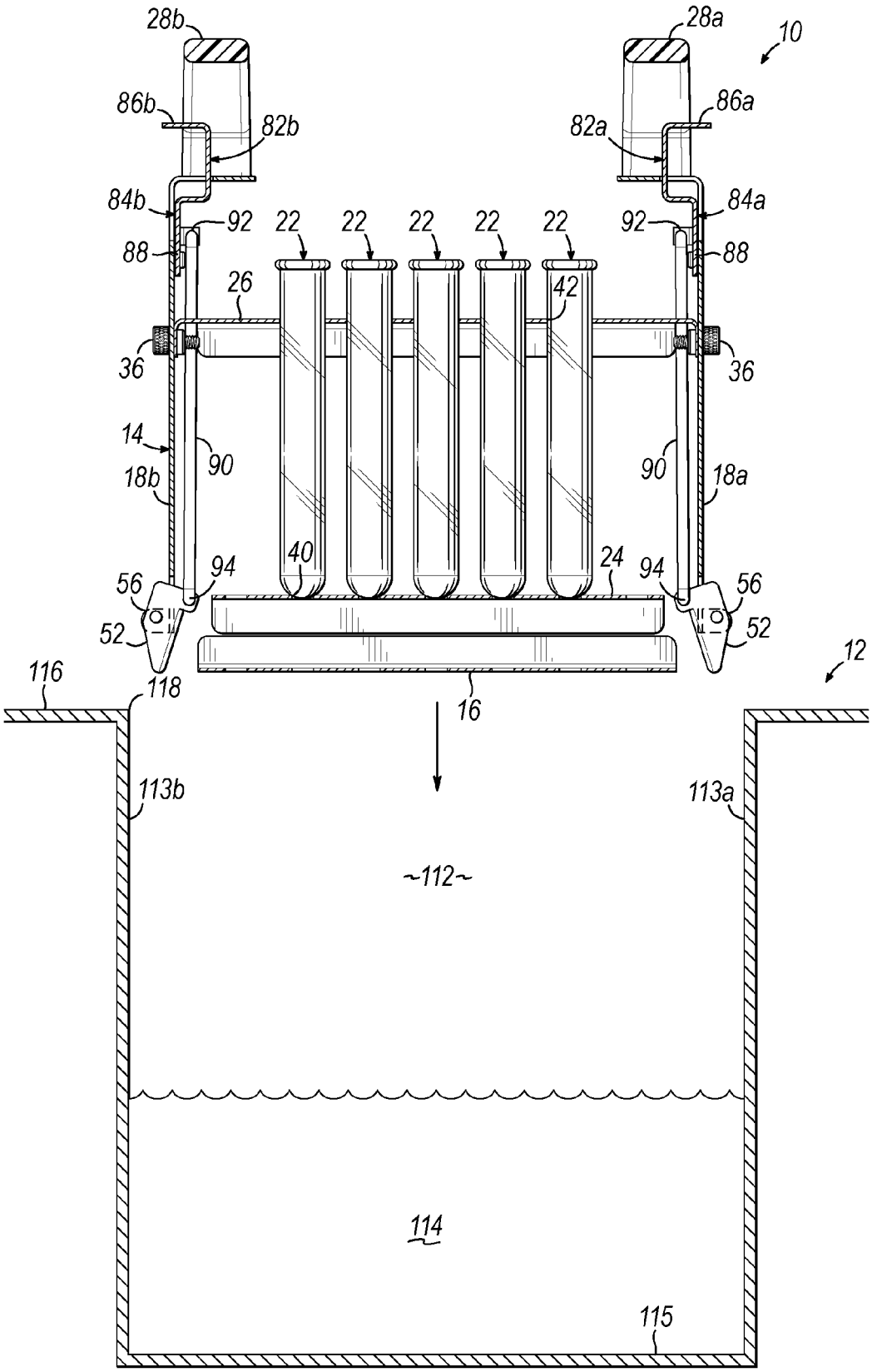
FIG. 6B is a schematic elevational view showing the rack with vessels of FIG. 5 being lowered into a reservoir of the temperature controlled bath, and with the support feet being in a stowed position.

The vessels 22 are supported by the vessel support 20 as follows. As shown in FIG. 6A, the vessels 22 are positioned above the upper tray 26 of the vessel support 20. In particular, the vessels 22 are aligned with the apertures 42 in the upper tray 26. The vessels 22 are lowered through the apertures 42 toward the base tray 24. The vessels are further lowered until the base ends 124 reach the base tray 24 and are received in the apertures 40 of the base tray 24, as shown in FIG. 6B. In that position, the apertures 40 receive a portion of the vessel bodies 122, and the apertures 42 receive another portion of the vessel bodies 122 (generally, the base ends 124). The apertures 40, 42 may also provide pathways for working fluid 114 to drain off the vessels 22 and the rack 10, for example. To that end, the rack 10 may also include apertures that provide similar drainage pathways for working fluid 114.

The rack 10 having the vessels 22 may be put into the temperature controlled bath 12. For example, a user can grasp the rack 10 by the handles 28*a*, 28*b* and hold the rack 10 above the temperature controlled bath 12. As shown in FIG. 6B, the rack 10 with the vessels 22 is positioned above the opening 118 in the housing 110 of the temperature controlled bath 12. The support feet 52 are moved to their respective stowed positions, if they are not already in the stowed position. For example, the adjustment mechanism 80 may be operated to move the support feet 52 to their respective stowed positions. With the support feet 52 in the stowed position, the rack 10 can fit between the reservoir side walls 113*a*, 113*b* and can be lowered into the reservoir 112. In particular, the rack 10 can be lowered into the reservoir 112 so that the vessels 22 come into contact with the working fluid 114.

Figure 6C:
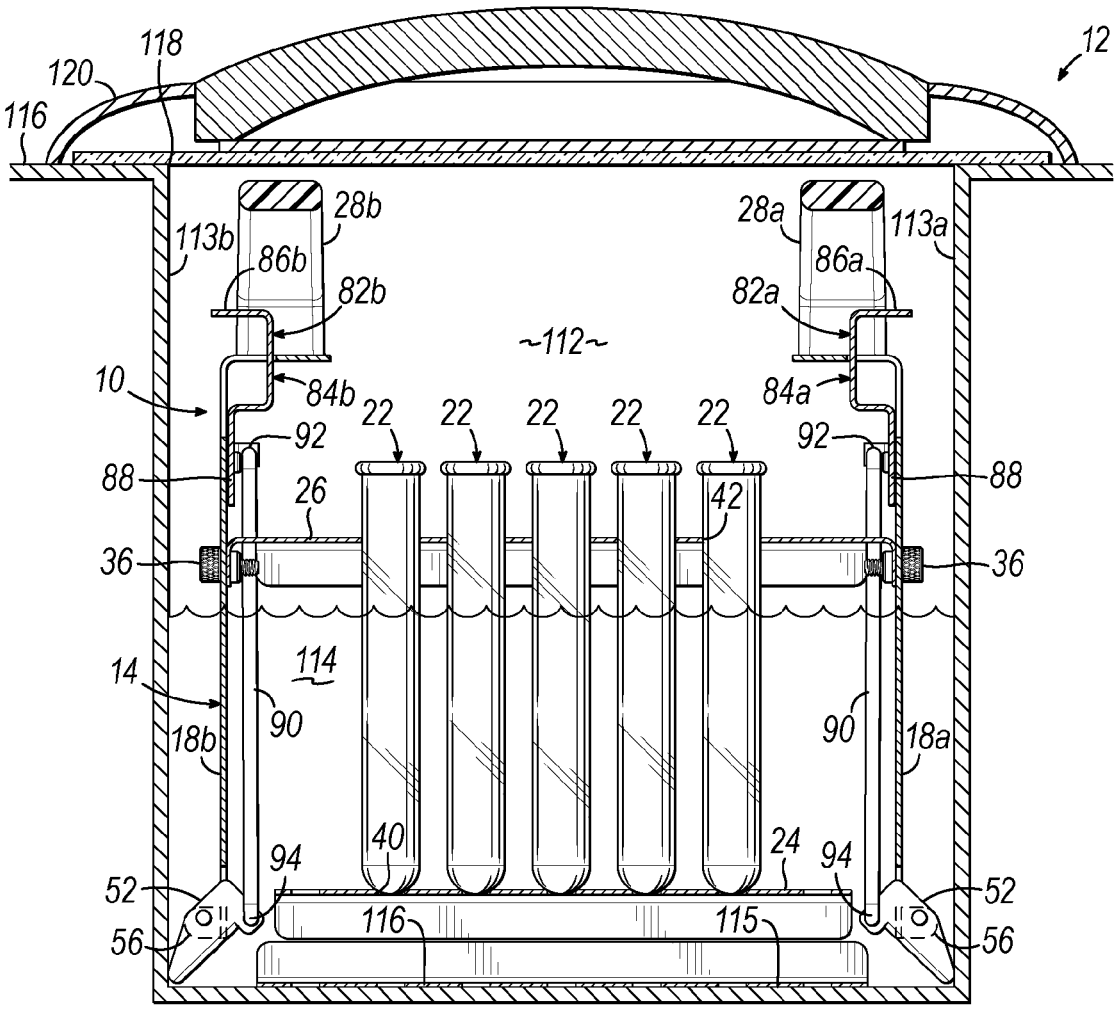
FIG. 6C is a schematic elevational view showing the rack with vessels of FIG. 5 with the rack positioned within the reservoir such that the vessels are at least partially surrounded by a working fluid contained in the reservoir.

As shown in FIG. 6C, the rack 10 is lowered into the reservoir 112 until it rests on the reservoir base 115. In that position, the rack 10, and in particular the vessel support 20, supports the vessels 22 in the working fluid 114. The temperature of the working fluid 114 is controlled by the temperature controlled bath 12. The vessels 22 are in thermal contact with the working fluid 114 which surrounds them, and thereby the temperature controlled bath 12 can provide control of the temperature of the material sample contained in the vessels 22. For example, the working fluid 114 can be maintained at a cool temperature to maintain the vessels 22 and their material sample at a cool temperature. Alternatively, the working fluid 114 can be maintained at a warm temperature to maintain the vessels 22 and their material sample at a warm temperature. As also shown in FIG. 6C, the lid 120 may be placed over the opening 118 when the rack 10 is inside the reservoir 112.

Figure 6D:
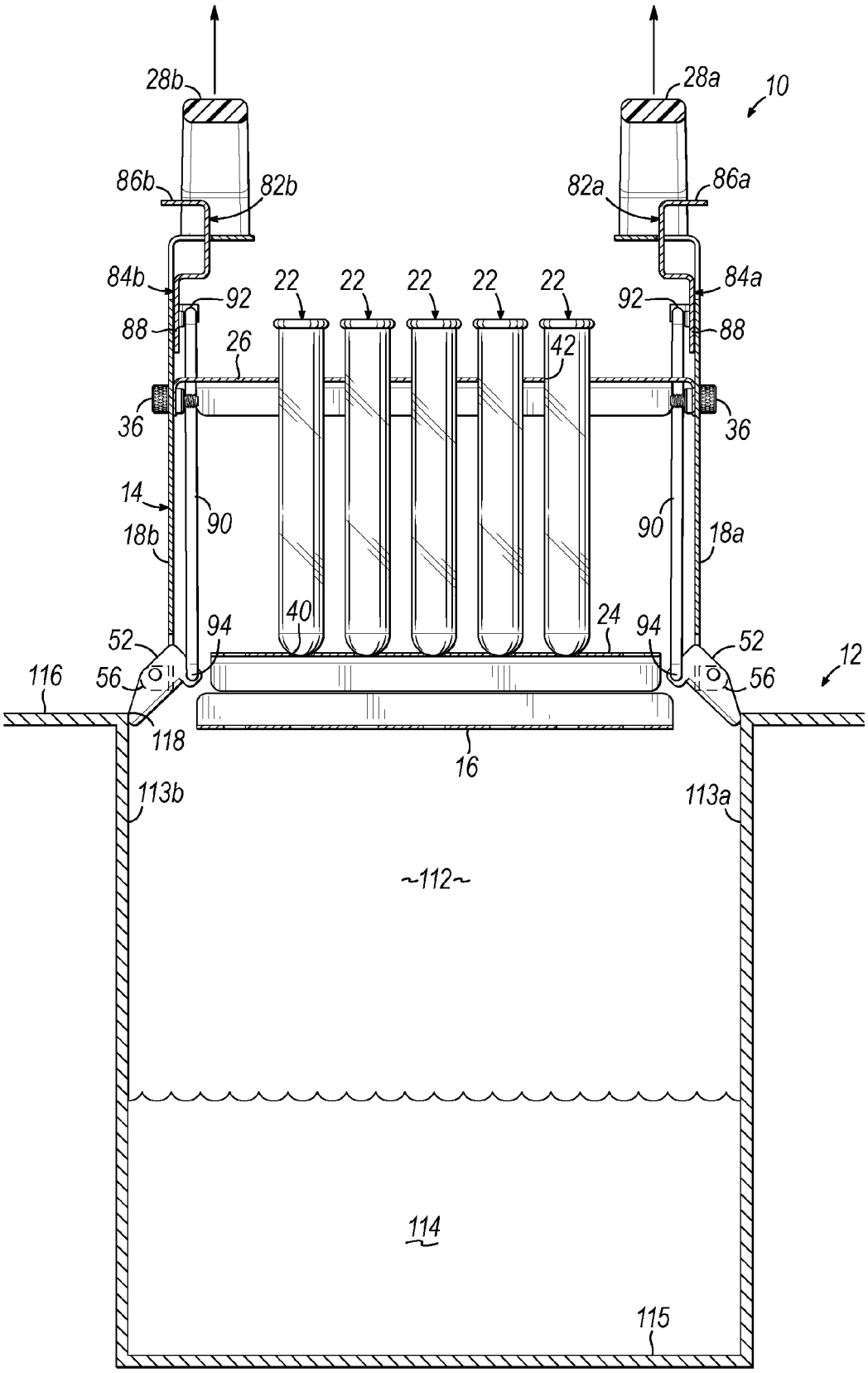
FIG. 6D is a schematic elevational view showing the rack with vessels of FIG. 5 being raised through the opening in the housing of the temperature controlled bath.

The rack 10 may be raised out of the reservoir 112, as shown in FIG. 6D. For example, a user can grasp the rack 10 by the handles 28*a*, 28*b* and lift the rack 10 upwardly. A user may remove the rack 10 from the reservoir 112 in order to gain access to the vessels 22, for example. The rack 10 is raised upwardly and through the opening 118 in the housing 110. The support feet 52 generally do not impede the rack 10 from being raised in the reservoir 112, even if the support feet 52 engage the reservoir side walls 113*a*, 113*b*. For example, even if the support feet 52 tend to move toward their respective deployed positions, the reservoir side walls 113*a*, 113*b* may constrain the support feet 52 from reaching respective deployed positions, as shown in FIGS. 6C and 6D.

Once the rack 10 is raised to an appropriate level, the support feet 52 are moved to their respective deployed positions. In some embodiments, the support feet 52 automatically move to their respective deployed positions when the support feet 52 are raised through or past the opening 118 and are no longer constrained from pivoting to the deployed position by the reservoir side walls 113*a*, 113*b*. In other embodiments, the support feet 52 may be manually moved to their respective deployed positions. For example, a user can operate the adjustment mechanism 80 or the support feet 52 can be engaged themselves to move the support feet 52 to their respective deployed positions.

Figure 6E:
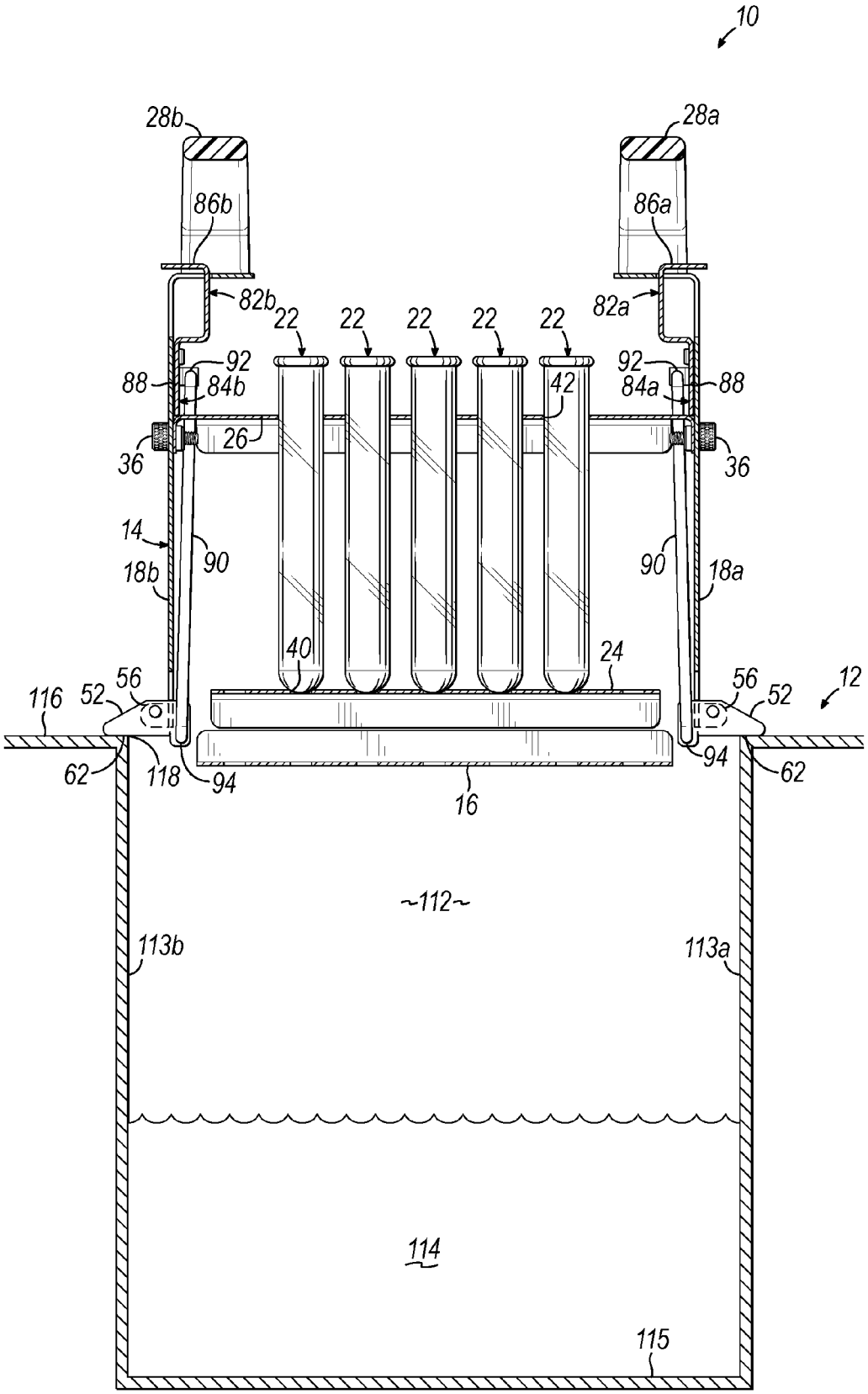
FIG. 6E is schematic elevational view showing the rack with vessels of FIG. 5 with the support feet being in a deployed position and resting on an upper surface of the housing of the temperature controlled bath.
Figure 7:
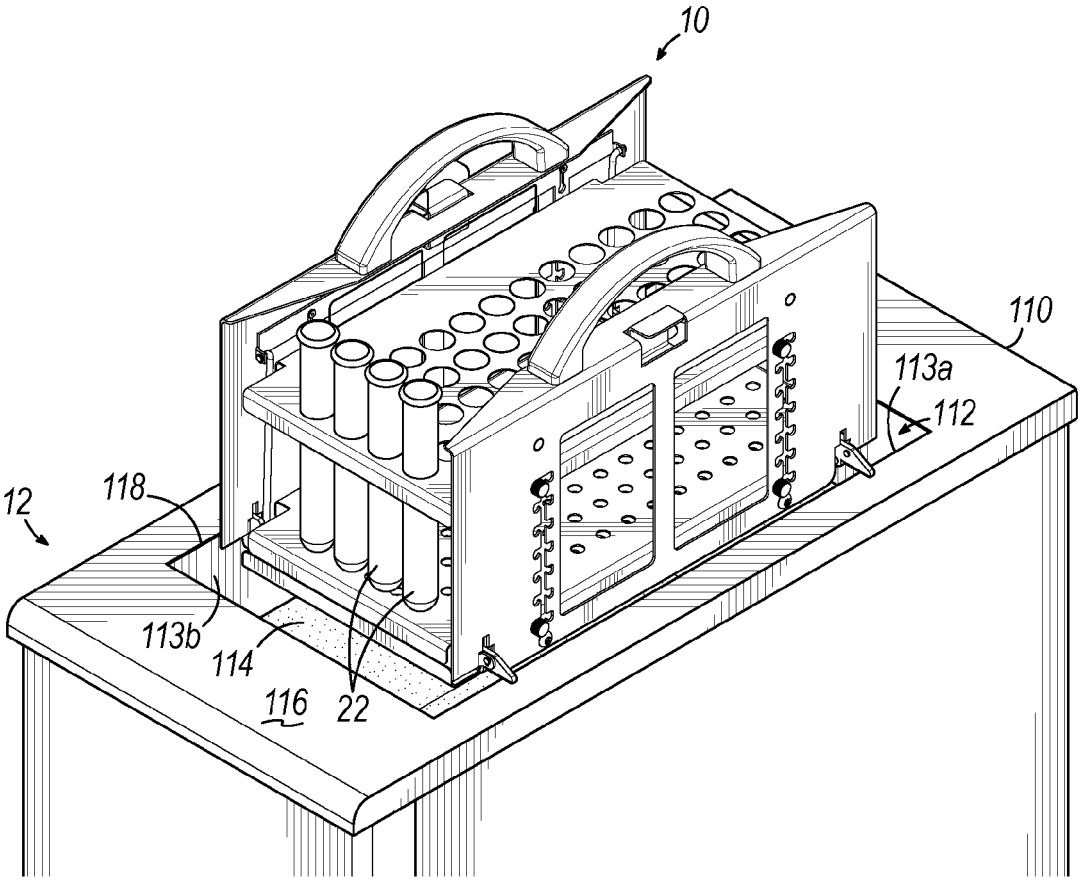
FIG. 7 is an isometric view of the configuration shown in FIG. 6E.

Once the support feet 52 are in their respective deployed positions, the rack 10 can be rested on the housing 110 of the temperature controlled bath 12, as shown in FIGS. 6E and 7. In particular, the base surfaces 62 of the support feet 52 can rest on the upper surface 116 of the housing 110. When the support feet 52 are in their respective deployed positions, the support feet 52 prohibit the rack 10 from being lowered into the working fluid 114 in the reservoir 112. As shown in FIGS. 6E and 7, the supporting foot assembly 50, including the support feet 52, support the rack 10 in such a manner that much of the rack 10, including the vessel support 20 and the vessels 22, is suspended over the opening 118 of the housing 110 above the working fluid 114 in the reservoir 112. Thereby, any residual working fluid 114 on the rack 10 or the vessels 22 can drain back into the reservoir 112, which is directly beneath the rack 10.

When it is desired to place the rack 10 back into the reservoir 112, a user moves the support feet 52 to their respective stowed positions, as discussed above, and lowers the rack 10, as also discussed above.

Advantageously, because the rack 10 may be placed on the temperature controlled bath 12, it is not necessary to place the rack 10 into another container, onto a tray, or onto an absorbent material when the rack 10 is removed from the temperature controlled bath 12. And since the rack 10 rests directly above the reservoir 112, the working fluid 114 can drain directly back into the reservoir 112. The working fluid 114 is thereby less likely to be spread around and contaminate the laboratory setting. In addition, the supply of working fluid 114 in the reservoir 112 is not diminished, thereby eliminating the need to replenish the working fluid that arose with prior racks.

Further advantageously, the rack 10 is usable with many types of temperature controlled baths, and with many types of vessels or other containers. Where the support feet 52 automatically move to their respective deployed positions, a user can simply raise the rack 10 from the reservoir 112 and immediately set the rack 10 to rest on the upper surface 116 of the housing 110. Thus, no additional steps for moving the support feet 52 to their respective deployed positions are required. In addition, the rack 10 can be put back into the reservoir 112 by moving the support feet 52 to their respective stowed positions and lowering the rack 10 into the reservoir 112.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details of the representative apparatus and method, and illustrative examples shown and described. Accordingly, departures may be made from such details without departing from the spirit or scope of Applicants' general inventive concept.

What is claimed is:

1. A rack for placement into a temperature controlled bath having a housing containing a reservoir with a supply of working fluid and an opening providing access to the reservoir, the rack comprising:

a rack body;

a vessel support supported by the rack body and configured for supporting at least one vessel;

a supporting foot assembly supported by the rack body and including a plurality of support feet, each support foot being configured for movement between a stowed position and a deployed position; and a user-operated adjustment mechanism operatively connected to at least one support foot and being configured to move the at least one support foot from the deployed position to the stowed position, the adjustment mechanism including a finger-actuated lever and a linkage operatively connecting the lever with the at least one support foot.

2. The rack of claim 1, further comprising a handle, the finger-actuated lever being positioned proximate the handle.

3. The rack of claim 1, each support foot being configured for automatically moving to the deployed position.

4. The rack of claim 1, each support foot including an upper surface, a base surface opposed from the upper surface, and a sloped surface extending from the upper surface toward the base surface.

5. The rack of claim 1, the supporting foot assembly including four support feet.

6. The rack of claim 5, each support foot being positioned generally near a lower corner of the rack.

7. The rack of claim 1, the rack body comprising a base, a first side wall, and a second side wall, the first and second side walls extending upwardly from the base and supporting the vessel support, and wherein each support foot extends outwardly from one of the first and second side walls when moved to the deployed position.

8. The rack of claim 7, the supporting foot assembly including two support feet associated with the first side wall and two support feet associated with the second side wall.

9. In combination, a temperature controlled bath having a housing containing a reservoir with a supply of working fluid and an opening providing access to the reservoir, and a rack for placement into a temperature controlled bath, the rack comprising:

a rack body;

a vessel support supported by the rack body and configured for supporting at least one vessel;

a supporting foot assembly supported by the rack body and including a plurality of support feet, each support foot being configured for movement between a stowed position and a deployed position; and a user-operated adjustment mechanism operatively connected to at least one support foot and being configured to move the at least one support foot from the deployed position to the stowed position, the adjustment mechanism including a finger-actuated lever and a linkage operatively connecting the lever with the at least one support foot.

10. The rack of claim 9, wherein when the support feet are moved to the stowed position, the rack can be lowered into the working fluid in the reservoir, and when the support feet are moved to the deployed position, the rack is prohibited from being lowered into the working fluid in the reservoir.

11. The rack of claim 9, the housing having an upper surface, and each support foot including a base surface configured for resting on the upper surface when the support feet are moved to the deployed position, the base surface being in a generally horizontal orientation in the deployed position and in an inclined orientation in the stowed position.

* * * * *